United States Patent [19]

Hersemeyer et al.

[11] Patent Number: 4,598,623

[45] Date of Patent: Jul. 8, 1986

[54] AMMUNITION-STOWAGE SYSTEM IN WHICH THE INDIVIDUAL SHELLS CAN BE INSERTED IN STORAGE TUBES

[75] Inventors: Klaus Hersemeyer, Kassel; Klaus-Peter Pietrzok, Kaufungen, both of Fed. Rep. of Germany

[73] Assignee: Wegmann & Co. GmbH, Kassel, Fed. Rep. of Germany

[21] Appl. No.: 560,021

[22] Filed: Dec. 9, 1983

[51] Int. Cl.[4] ..... F41F 9/06; F42B 37/02

[52] U.S. Cl. ..... 89/34; 206/3; 221/87

[58] Field of Search ..... 89/34, 36 K, 36 H; 188/67, 74; 221/87; 206/3; 312/45, 72

[56] References Cited

U.S. PATENT DOCUMENTS 3,866,720 2/1975 Wallerstein ..... 188/67
4,487,104 12/1984 Schiele et al. ..... 89/34

FOREIGN PATENT DOCUMENTS 3125406 2/1983 Fed. Rep. of Germany ..... 206/3

*Primary Examiner*—David H. Brown

*Attorney, Agent, or Firm*—Sprung Horn Kramer & Woods

[57] ABSTRACT

In ammunition-stowage systems in which the individual shells can be inserted in storage tubes, damage to the shells is prevented when they are inserted too rapidly. A braking device is positioned for this purpose at each storage tube and brakes the longitudinal travel of the shell as soon as the shell arrives at the position inside the storage tube that corresponds to the rest position, in which it is secured in place by the securing hooks. The braking device preferably grasps the impact part of the shell and is connected to a stop that can be displaced longitudinally by a system of rods that activates the braking device when it is displaced as soon as the shell comes to rest against the stop and the stop is shifted out beyond its rest position into the shell-insertion position by the moving shell. The braking device consists of a braking block that is mounted in such a way that it can move on two parallel connecting rods and is thrust forward and forced by the connecting rods against the shell, specifically against the impact part, when the rod system travels forward longitudinally.

3 Claims, 5 Drawing Figures

AMMUNITION-STOWAGE SYSTEM IN WHICH THE INDIVIDUAL SHELLS CAN BE INSERTED IN STORAGE TUBES

BACKGROUND OF THE INVENTION

The present invention relates to an ammunition-stowage system in which the individual shells can be inserted in storage tubes. Ammunition-stowage systems of this type are often built into the turrets of tanks or into other firing positions. The storage tubes must be restocked with ammunition before or during pauses in the battle when the ammunition they contain gets used up. The shells must then be inserted into the individual storage tubes, which occurs more or less rapidly, and must somehow be braked when they have arrived at their final position. Braking may be brought about for example by means of stops in the storage tubes that prevent the shells from being inserted too far. In this case, however, the shells will forcefully impact against the stops, especially when they are inserted rapidly, so that the shells can be damaged even when the stops are designed to be resilient. A particular danger is that the kinetic energy of the round can generate an axial elongation of the ammunition when insertion is braked by a stop on the base of the shell, which must be avoided in particular when ammunition with combustible propellant caps is employed.

SUMMARY OF THE INVENTION

The object of the present invention is to brake the shells being inserted into the storage tubes in such a way as to prevent damage. The point of departure for the invention is that a braking device is positioned for this purpose at each storage tube and brakes the longitudinal travel of the shell as soon as the shell arrives at the position inside the storage tube in which it is intended to be located and which can be designated the rest position. Securing hooks are as a rule mounted on the storage tubes to prevent the shells from falling out of the tubes when they are shaken, and the rest position corresponds accordingly to the position in which the shells are secured in place by the securing hooks. The braking device is practically positioned in the storage tube in such a way that it grasps the impact part of the shell, the frontmost part that is. It should be noted in this context that the concepts of "forward" and "backward" always refer in what follows to the direction in which the shell is fired and that "front" consequently refers to the point of the round and "rear" to the base of the shell. The advantage of mounting the braking device at the impact part is that the most that can occur when the shell is braked is a jolt, which will not result in damage, and not an axial elongation of the ammunition. The braking device can be positioned so that braking will occur when the shell, the impact part of the shell for example, arrives at the braking device without the device necessarily having to be especially activated. It is especially practical to activate the braking device by providing a stop that can be shifted longitudinally at each storage tube so that the stop will be entrained forward when the shell is inserted, resulting in activation of the braking device. The stop and the braking device can for this purpose be connected by a system of rods that activates the braking device when it is displaced as soon as the shell comes to rest against the stop and the stop is shifted out beyond its rest position by the moving shell.

The stop can also be employed to thrust the shell far enough out of the storage tube when ammunition is being removed for it to be easily grasped. In this case the braking device will not be activated until the stop is displaced far enough forward as ammunition is inserted for the shell to arrive in its intended rest position. A pin can be positioned on the stop for this purpose and come into non-positive contact with the rod system that activates the braking device while the stop is traveling longitudinally as soon as the stop arrives in the rest position. Thus, the braking device will not be activated as long as the stop is in back of the rest position and the shell can be inserted unimpeded by the braking device until it arrives in the rest position. The rod system will not be shifted forward until the instant in which the pin on the stop travels forward beyond the rest position and comes into non-positive contact with rod system, activating the braking device. The braking device can be activated in a practical way when it contains a braking block that is mounted in such a way that it can move on two parallel connecting rods and is thrust forward and forced by the connecting rods against the shell, specifically against the impact part, when the rod system travels forward longitudinally.

DETAILED DESCRIPTION OF THE PREFERRED EMBODIMENTS

Figure 1:
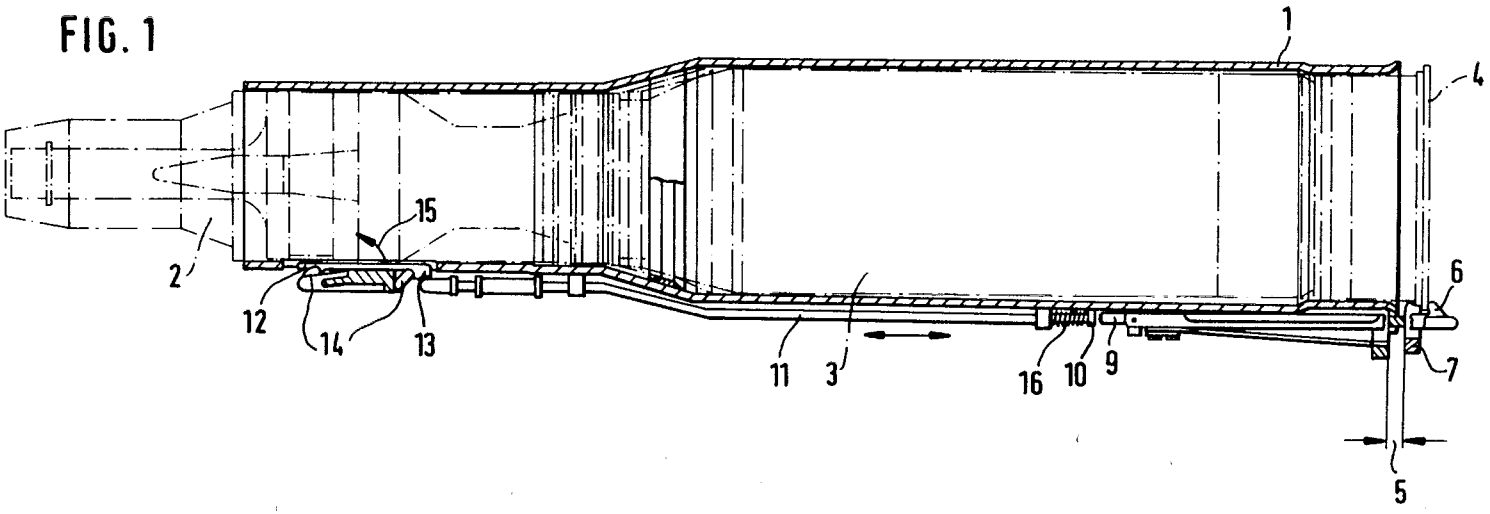
FIG. 1 is a side view of a storage tube in an ammunition-stowage system with an inserted shell and FIG. 2 is a bottom view of the braking device, the braking-rod system, and part of the stop.
Figure 2:
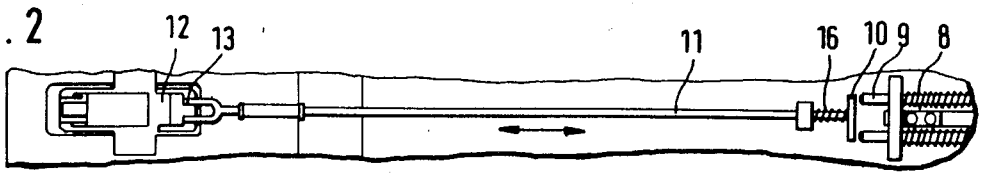
Figure 3:
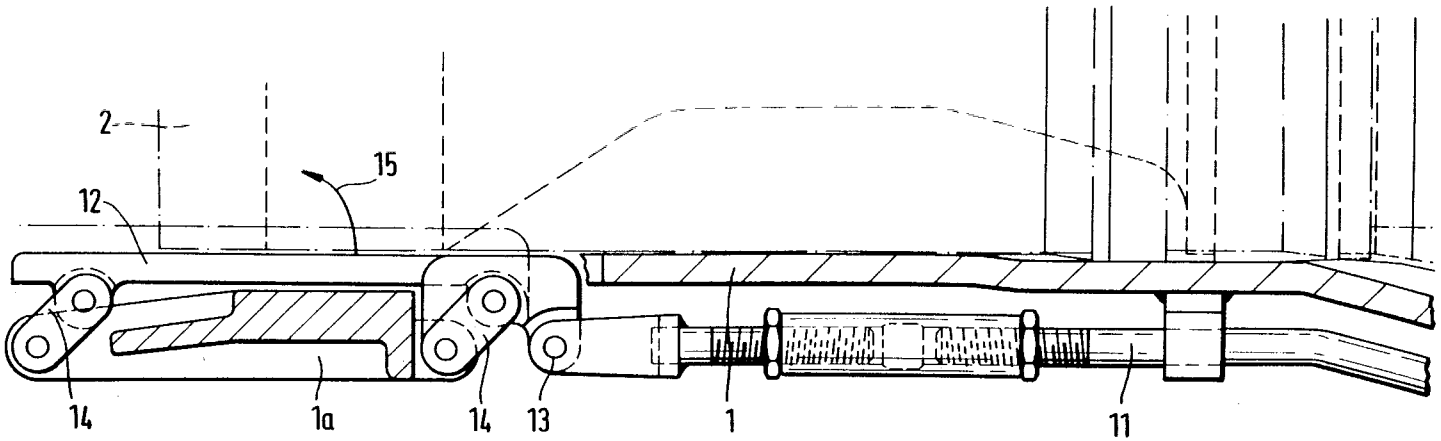
FIG. 3–5 are detail portions of the device shown in FIGS. 1 and 2.
Figure 4:
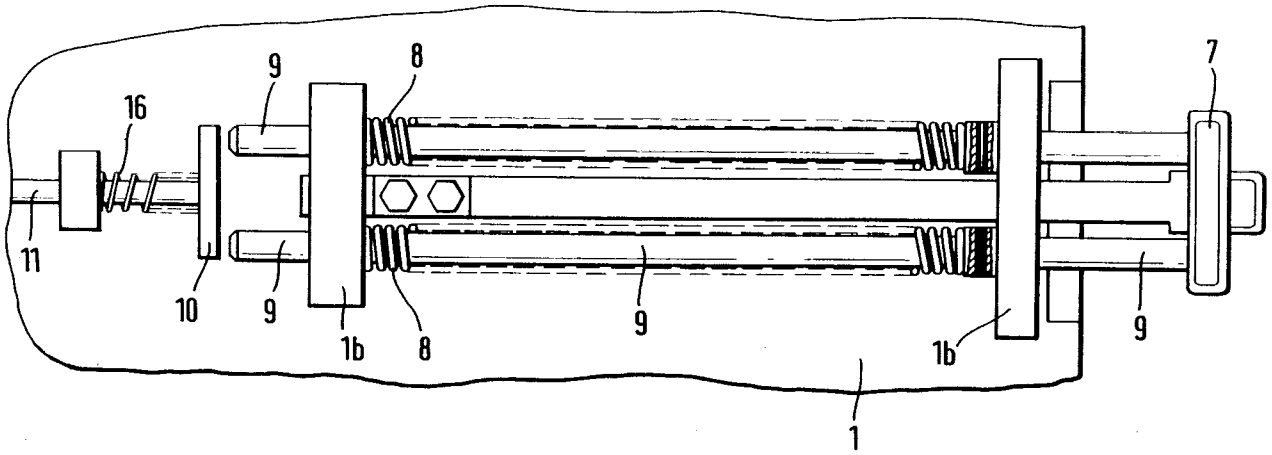
Figure 5:
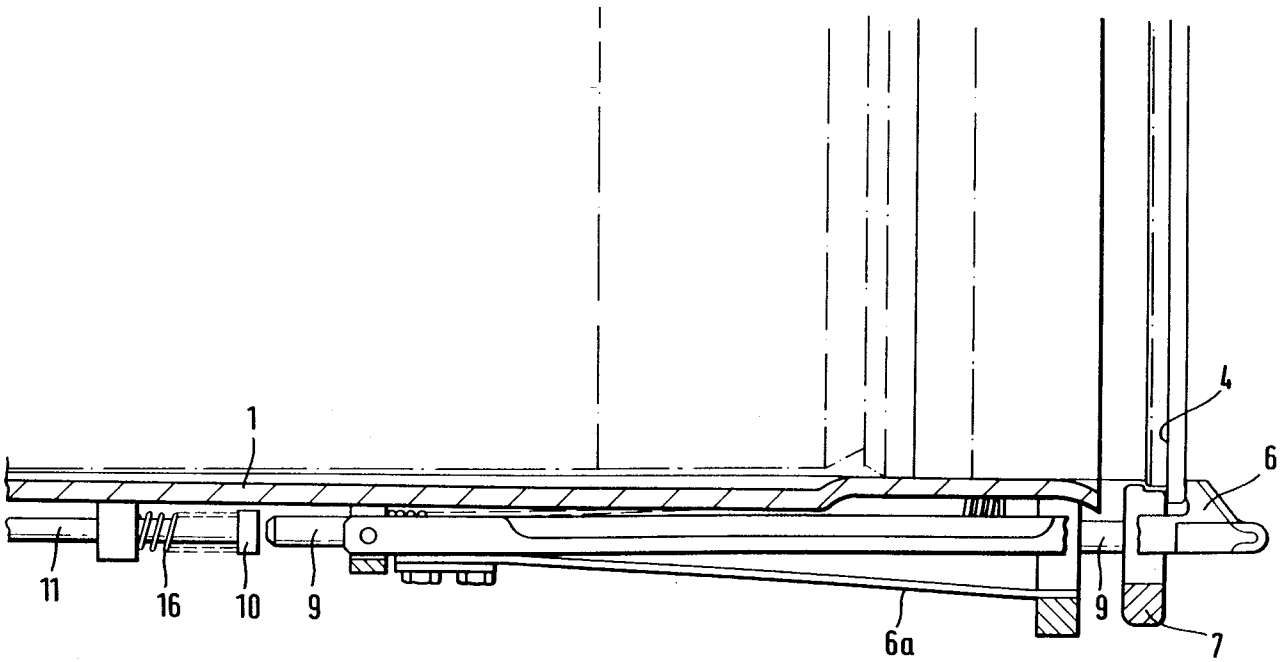

A shell, which consists of a body 2, a cartridge 3, and a base 4, is positioned in the storage tube 1 of an ammunition-stowage system. The shell in FIG. 1 is in the rest position, extending slightly out of rear end of storage tube 1. Although the shell can accordingly also be inserted even farther into storage tube 1 to the extent of residual travel 5, it will in that case be restored to the rest position as will be described. Once the shell has arrived in the rest position, a securing hook 6 engages the rear of base 4 and prevents the shell from falling out of the rear of storage tube 1 when shaken. A stop 7 rests against the front of base 4. Since stop 7 is forced to the rear by springs 8, specifically beyond the illustrated rest position, it also functions as an extractor. Stop 7 is forced forward when a shell is inserted and can even be forced forward beyond the rest position to the extent of residual travel 5 when a shell is inserted rapidly. At the front of the device that guides the stop there are pins mounted in guides 16 9 that contact a plate 10 as soon as the stop arrives in the rest position. Plate 10 is connected with a braking block 2 by a system 11 of rods through a joint 13. The braking block is suspended from body la on two parallel connecting rods 14 in such a way as to come to rest against body 2 when advanced by the rod system, braking the forward motion of the body.

The process of inserting ammunition into the ammunition-stowage system will now be described.

The shell is inserted more or less rapidly into storage tube 1 from the rear. Before the shell arrives in its rest position its base strikes against stop 7 entraining the stop forward. At the instant the shell arrives in the rest position but is still traveling forward, securing hook 6 biased by spring *6a* engages, although it is still ineffective at this moment, and pins 9 come into non-positive contact with plate 10, so that rod system 11 will now also participate in the continued forward motion. This forces braking block 12 in the direction indicated by arrow 15 against the body of the shell, braking the motion of the body and hence the shell as a whole. As soon as the shell comes to rest, stop 7, which is subject to tensioned springs 8, forces the shell farther back until the base again comes into contact with securing hook 6, which prevents further backward motion. The braking device is again simultaneously released during this motion and a recuperating spring 16 also restores the rod system that activates the braking device to the rest position, in which pins 9 contact plate 10, without the braking device being activated. As is evident, the more rapidly the shell is inserted in the storage tube, the more forcefully the braking device is set and the farther the rest position is exceeded, with the resulting occurrence of residual travel, because of the speed of the shell. Braking must be strong enough to completely brake the shell before maximum residual travel is attained. Exceeding this maximum can result in damage.

We claim:

1. An ammunition-stowage system comprising: at least one storage tube receptive at the rear thereof of an individual shell having a base and a body; and braking means positioned on each storage tube for braking the longitudinal movement of a shell inserted into the tube, the braking means comprising a braking block disposed at the front of the storage tube to be adjacent the body of an inserted shell, two parallel connecting rods mounting the braking block for pivotal movement from a rest position to a braking position wherein the block rests against the shell body and brakes its forward motion, a system of rods pivotally connected at one end to the connecting rods and movable axially towards the front of the tube to pivot the braking block into its braking position, a plate at the rear end of the system of rods, a stop slidably mounting at the rear of the tube in the path of the base of a shell to be inserted and for movement towards the front of the tube including spring biasing means the stop away from the front of the tube, and a plurality of pins connected to the stop and spaced from the plate and movable into the plate in response to contact of the stop with the shell base to thereby move the system of rods and pivot the braking block.

2. the ammunition-stowage system as in claim 1, further comprising a securing hook positioned at the rear end of the storage tube for snapping in against the rear of the shell base to define a rest position for the shell, wherein said stop is forced back by the spring means beyond the rest position of the shell to maintain the shell in place against the hook.

3. The ammunition-stowage system as in claim 1, further comprising a recuperating spring biasing the system of rods rearwardly with respect to the tube.

* * * * *